United States Patent [19]

Forrest et al.

[11] Patent Number: 4,775,017

[45] Date of Patent: Oct. 4, 1988

[54] DRILLING USING DOWNHOLE DRILLING TOOLS

[75] Inventors: John Forrest; Rory Tulloch, both of Aberdeen; William Stewart, New Pitsligo, all of Scotland

[73] Assignee: Drilex UK Limited, London, England

[21] Appl. No.: 133,062

[22] PCT Filed: Apr. 10, 1987

[86] PCT No.: PCT/GB87/00245

§ 371 Date: Dec. 9, 1987

§ 102(e) Date: Dec. 9, 1987

[87] PCT Pub. No.: WO87/06300

PCT Pub. Date: Oct. 22, 1987

[30] Foreign Application Priority Data

Apr. 11, 1986 [GB] United Kingdom ..... 8608857

[51] Int. Cl.[4] ..... E21B 4/02; E21B 4/20; E21B 7/28; E21B 21/08

[52] U.S. Cl. ..... 175/65; 175/103; 175/107; 175/385

[58] Field of Search ..... 175/65, 57, 107, 103, 175/325, 92, 94, 53, 26, 385, 424

[56] References Cited

U.S. PATENT DOCUMENTS 3,133,603 5/1964 Lagacherie et al. ..... 175/107
3,661,218 5/1972 Brown ..... 175/107
3,802,515 4/1974 Flamand et al. ..... 175/26 X
4,401,170 8/1983 Cherrington ..... 175/73

FOREIGN PATENT DOCUMENTS 2054008 2/1981 United Kingdom .

OTHER PUBLICATIONS

Washburn, Oil & Gas Journal, vol. 79, No. 10, Mar. 9, 1981, pp. 87–92.

*Primary Examiner*—Stephen J. Novosad
*Attorney, Agent, or Firm*—Bell, Seltzer, Park & Gibson

[57] ABSTRACT

A downhole motor (19) is mounted in a drill pipe (13) above a hole enlarger (14) intermediate ends of the pipe (13). The motor drives a lower pilot bit (28). A split flow bypass device (24) above the motor (19) allows part of the flow to drive the motor and the remainder to bypass through a central passage, the divided flows rejoining below the motor (19) with a restricted flow through jet nozzles (32) to the hole enlarger cutter (15). Flow passes centrally of the output shaft (26), past a bleed valve (34) bleeding up to 5% to an outer shaft space for lubricating bearings (30), to flow restrictor jet nozzles (33) of the pilot bit (28). In use flow is controlled to drive the motor (19) to drive the pilot bit (28) at desired speed and the drill string is rotated from the rotary platform of a drill rig to drive the hole enlarger (14) so that the hydraulic requirements of the hole enlarger (14) and the pilot bit (28) are met while only allowing sufficient fluid to pass through the motor (19) to give the required output speed at the pilot bit (28).

10 Claims, 1 Drawing Sheet

DRILLING USING DOWNHOLE DRILLING TOOLS

This invention relates to drilling holes using downhole tools and particular to drilling large diameter holes.

Current methods employed to drill large diameter holes in the earth's crust for oil and gas or other minerals are varied. The methods employed are normally dependent upon the bore size and formation being cut.

Roller cone bits drilling up to 36" or 1 meter diameter in a single cut are known to have been used in spudding operations (spudding is the initial bore from the earth's surface). Alternatively, as a first option, pilot drilling followed by either a hole opener or under-reamer to enlarge the pilot hole is commonly employed when drilling large diameter bore holes in harder formations or at greater depths. The hole enlarging is carried out either as a secondary operation when rotary drilling, or alternatively, as a simultaneous operation by using a downhole drilling motor or turbine to supply power to the pilot drilling bit and using rotary power to drive the hole opener or under-reamer which is positioned above the downhole drilling motor or turbine. A third option is to use the downhole drilling motor or turbine to supply power to both the pilot drill bit and the hole enlarger.

When drilling with a configuration as illustrated in FIG. 1*a*, according to the first option, a multi-lobe positive displacement motor (PDM) 1 is preferred to a turbine or conventional ½ lobe motor since it offers the combination of low speed and high torque at the drilling bit. A hole enlarger 2 is mounted at the upper end of a drill pipe 3 containing the motor 1 which is coupled through a universal joint transmission 4 to a a lower drive shaft 5 supported in bearings 6 and driving a lower bit box 7 supporting a pilot drill bit 8.

This system has the disadvantage of being unable to maintain constant hydraulic horsepower to both the pilot bit and the hole enlarger (hole-opener or under-reamer) since pressure drop across the PDM varies with load requirements at the pilot drilling bit. This results in uneven wear at the cutting edge and premature dulling of the cutters causing a slow-down in penetration rate and early pulling out of hole to change cutters.

The system of FIG. 1*b* has the motor 1 mounted in a lower drill pipe 3 driving a lower drive shaft 5 through a universal joint transmission 4, the drive shaft being supported in bearings 6 and is drivingly coupled via a lower bit box 7 to a hole enlarger 2 carrying a pilot drill bit 8 at its lower end.

The system illustrated in FIG. 1*b* also benefits from the low speed, high torque output characteristics of a multi-lobe positive displacement motor 1 but this system has the disadvantage of having the rotational speed of the pilot drill bit being the same as for the hole enlarger. This results in different cutting speeds at the cutting edges and premature wear of the cutters.

It is an object to provide an improved method of and downhole assembly for downhole drilling using a pilot drill and a hole enlarger.

A method of downhole drilling according to the invention comprises mounting a downhole motor within a drill pipe above a hole enlarger mounted at a lower end of the pipe, with a transmission shaft of the motor extending beyond the lower end of the pipe to a pilot bit spaced downwardly from the hole enlarger; whereby the hole enlarger may be driven from the rotary platform of a drilling and the pilot bit by the motor transmission shaft, and bypassing part of the total fluid flow to the motor and regulating the total fluid flow below the motor between the pilot bit and to the hole enlarger, so that the total flow of fluid to be such as to permit the hydraulic requirements of the pilot bit and the hole enlarger to be met whilst only allowing sufficient fluid to pass through the motor stator/rotor pair to give the required output speed at the pilot bit.

A downhole drilling assembly according to the invention comprises a drill pipe having a hole enlarger at a lower end, a downhole motor mounted within the drill pipe above the enlarger with a transmission shaft extending beyond the enlarger to a pilot bit spaced below the enlarger, a dump valve above the motor, a bypass split flow device above the motor stator/rotor pair leading to a flow path bypassing the stator/rotor and linking up with the rotor/stator flow path below the rotor/stator pair, a flow distributor below the stator/rotor adapted to direct the flow through a first path via jet nozzles to the hole enlarger, a second path via jet nozzles to the pilot drill bit and a third path through a bearing section for an output shaft of the motor for the pilot bit.

The bottom hole assembly of the invention simultaneously drills the pilot bore hole using the power developed from the PDM and enlarges the hole using the rotary table to supply the power required by the hole enlarger which is mounted in the drill string in a lateral position between the source of power generation of the PDM (the stator/rotor section) and the pilot bit. This lateral positioning of the hole enlarger ensures that the hydraulic horsepower at both cutting edges, i.e. at the pilot drilling bit and the hole enlarger is not effected by the load requirements of the PDM. The distance between the hole enlarger and the pilot bit should also be kept to a minimum and should not exceed 20 ft. This will enable both cutting edges to be cutting the same formation for as much of the drilling time as possible.

A requirement of this invention is that the power unit of the PDM, the stator/rotor section, be equipped with a bypass flow device which will allow the total amount of fluid required at the pilot bit and the hole enlarger to pass through the PDM but only have sufficient fluid pass through the stator/rotor pair to give the required output speed at the pilot bit.

This invention gives maximum options on independent selection of cutter speed (RPM) and hence cutting speed (ft/min) at both cutting edges, i.e. at the pilot drill bit and the hole enlarger which together with the ability to preselect the hydraulic horsepower at the cutting edges optimises the drilling conditions and improves performance both in terms of rates of penetration and in cutting tool life.

The invention will now be described, by way of example, with reference to the accompanying partly diagrammatic drawings, in which:

FIG. 1(*b*) is a schematic elevation of a downhole drill assembly according to a second example of the prior art discussed in the preamble to this specification.

Figure 2:
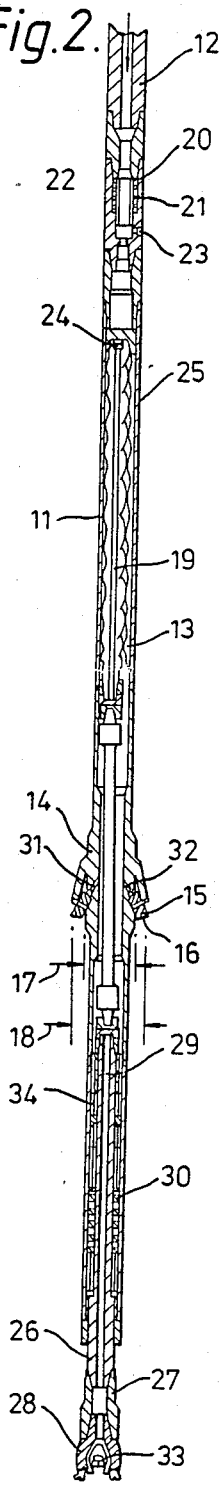
FIG. 2 is a schematic sectional elevation of a downhole drill assembly according to the invention.

In FIG. 2 a drill sub-assembly 11 according to the invention is connected to the lower member 12 of a drill string and comprises a drill pipe 13 having a hole enlarger 14 intermediate its ends. The hole enlarger 14 is provided with a hole enlarger cutter 15 mounted on an outwardly and upwardly inclined spindle and provided with cutting edges 16 defining an inner diameter 17 and outer diameter 18.

A positive displacement motor 19 is mounted within the drill pipe 13 above the hole enlarger 14 with an upper dump valve 20 having a sliding spool 21 loaded by a spring 22, and side ports 23. A split flow bypass device 24 is positioned between the dump valve 20 and stator/rotor 25 of the motor 19 leading to a flow path through the stator/rotor and a bypass path through the rotor. The paths join below the stator/rotor 25.

A transmission output shaft 26 leads downwardly from the rotor of the motor 19 beyond the lower end of the pipe 13 to a bit box 27 carrying a lower pilot bit 28 and a flow path 29 leads downwardly centrally of the shaft 26 to the pilot bit 28. The output shaft 26 is supported within the pipe 13 in bearings 30.

The pilot bit 28 has an outside diameter slightly greater than the inner cutting diameter 17 of the enlarger cutter 15 and less than the outer diameter 18 thereof.

The region at the lower end of the motor 19 acts as a flow distributor, fluid flowing within the pipe 13 and around the transmission shaft. The enlarger has downwardly directed flow passages 31 leading from the pipe 3 flow passage to the enlarger cutter 15 through flow restrictor jet nozzles 32. The central flow passage of the lower output shaft 26 leads to flow restrictor or jet nozzles 33 at the pilot bit 28 and about the transmission output shaft 26 through the bearings 30 and a bleed valve 34 to the lower end of the pipe 13.

When it is decided to run the assembly illustrated in FIG. 2 as a method of boring a large diameter borehole, then proper planning of the bottom hole assembly and careful selection of the drilling fluid hydraulics programme must precede any drilling operation if improved drilling performance is to be achieved.

The correct bit 33 must be chosen to suit the formation being cut.

The correct type and style of hole enlarger 14 must be chosen again to suit the formation but also to complement the bit 33.

A positive displacement mud motor 19 with suitable output characteristics to drive the pilot drill bit 28 and with a split flow device 24 which allows sufficient drilling fluid to pass through the PDM 19 to suit the hydraulics and yet rotate the pilot drill bit 28 at the required speed must be selected.

The respective rotational speeds at the pilot drill bit 28 and at the hole enlarger 14 should be selected.

The correct size of nozzle for the PDM split flow device 24 can be selected and fitted once the total flow requirements at the cutting edges are known.

The nozzles sizes to balance the hydraulic horsepower per cutting edge can also be selected and fitted. With the planning stage of the invention now complete, the invention illustrated in FIG. 2 will now be described.

The assembly of the invention is run into hole as part of a planned assembly connected to the drilling rig by means of a drill pipe 12 with a hollow bore through which the drilling fluid is pumped in the direction of the arrow on FIG. 2. To commence drilling, the hydraulic pumps are switched on and fluid flows down the drill pipe 12 in the direction of the arrow. The amount of fluid being pumped is predetermined as described earlier. The drill pipe 12 is also caused to rotate by means of a rotary table mounted at the drilling rig and independently powered. The rotational speed of the rotary table is also predetermined as described earlier. The rotational speed propels the drill pipe 13 and the drill string 12, including the outer casing of the PDM 19 and the hole enlarger 14.

When the fluid enters the top of the PDM 19, the flow rate of the fluid is sufficient to cause a pressure differential across the sliding spool within the dump valve 20. This differential pressure acting on the surface area of the sliding spool creates a force in excess of the spring force beneath the sliding spool causing the spool axially to move downwards and blank off the side ports thus causing the drilling fluid to enter the top of the power section (stator/rotor 25).

The drilling fluid has two flow paths to travel through at this stage. Firstly throuh the stator/rotor 25. The design of the helical screw stator/rotor pair is such that the rotor has one tooth less than the stator leaving a flow path between the stator/rotor through which the fluid can travel causing the rotor to rotate around its own axis and precess around the stator axis.

Figure 1A:
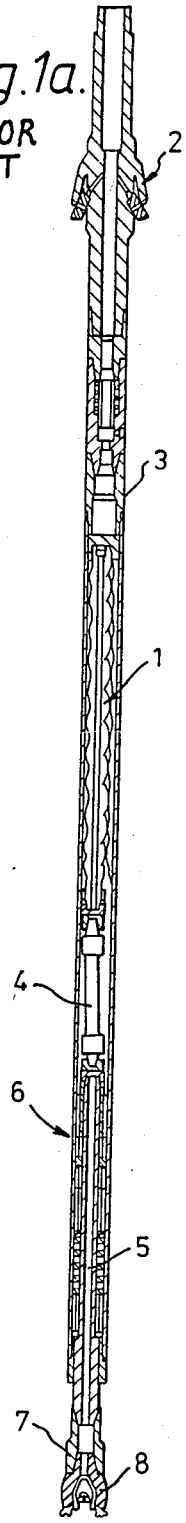
Fig.1a. PRIOR ART
FIG. 1(*a*) is a schematic elevation of a downhole drill assembly according to a first example of the prior art discussed in the preamble to this specification.
Figure 1B:
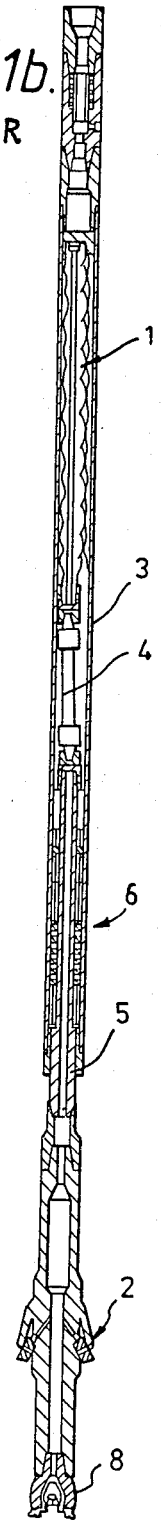
Fig.1b. PRIOR ART

Work is done by the drilling fluid in overcoming resistance to rotation and the pressure loss along the axis of the stator/rotor is proportional to the output torque delivered to the drill bit 33. As the resistance to rotation at the drill bit 33 increases or decreases dependent upon the formation being cut and the quality of the cutting edge of the drill bit, so the pressure loss along the axis of the stator/rotor 25 varies. (It is this varying pressure drop which prohibits the hydraulic horsepower being delivered to the drill bit 33 and the hole enlarger 14 to be of constant distribution in the previous invention as illustrated in FIG. 1).

The second flow path available to the drilling fluid at the top of the power section is through the bypass split flow device 24. Here a preselected diameter of pilot hole through a nozzle allows fluid to pass through the centre of the rotor and rejoin the other flow path immediately below the stator/rotor 25. The size and design of the nozzle selected causes the same pressure loss for a predetermined flow of fluid through the nozzle as the pressure loss across the length of the stator/rotor 25. This device allows sufficient drilling fluid to pass through the stator/rotor 25 to cause the rotor to rotate at a predetermined rotational speed, (the rotational speed of the rotor in a PDM is directly proportional to the flow rate) and simultaneously bypass an additional amount of drilling fluid through the centre of the rotor such that the combined fluid flow rate is equal to the required amount to give correct hydraulic horsepower to the cutting edges.

At the bottom end of the stator/rotor 25, the flow of drilling fluid from the stator/rotor flow path and the bypass split flow path link up. Here it passes around the transmission shaft which connects the rotor to the output shaft 26 and hence, the drill bit 33.

This area within the PDM 19 acts as a distribution manifold from which the drilling fluid can then divide into three different flow paths, firstly via the jet nozzles 32 to the hole enlarger 14, secondly through the hollow bore of the output shaft 26 via the jet nozzles 33 to the pilot drill bit 28, and thirdly through the bearing section 30.

The third flow path, through the bearing section 30, is restricted by a mechanical face seal (the bleed valve 34) which is designed to withstand pressure drops above normally used for bit hydraulics. (The Drilex D950 PDM bleed valve is rated to 1500 psi.) The principle of the design of the bleed valve allows a maximum of 5% of the total drilling fluid to vent across the valve to act as a lubricant to the bearings when operating within its rated pressure range. The hydraulic pressure loss through the hollow bore of the output shaft 26, the second flow path, can be treated as negligible. The flow distribution between the pilot drill bit 28 and the hole enlarger 14 is, therefore, divided according to the preselected nozzle bore sizes.

This flow distribution remains unaffected by the variable pressure loss across the rotor/stator since the flow distribution is made after the variable working element (stator/rotor).

The preselected total flow requirements and the nozzles sizes selected for both the hole enlarger and the pilot bit determine the hydraulic horsepower at the cutting edges. This will remain constant during the cutting operation.

As a result of the invention:

(i) When drilling large diameter bore holes in the earth's crust at varying depths, drilling performance will be improved when using a bottom hole assembly which allows hydraulic horsepower and cutting speed to be optimized by having a pilot drill bit mounted on the output end of a downhole positive displacement mud motor and powered by the mud motor and a hole enlarger, a hole opener or under-reamer which is driven by the power supplied by the rotary table but is mounted laterally on the drill string between the power section (stator/rotor) of the PDM and the pilot drill bit at a distance not exceeding 20 ft. from the pilot bit. This configuration allows the drilling fluid to flow through the carefully preselected bit nozzles or flow restrictors to both cutting edges, i.e. the pilot bit and the hole enlarger without any variation in relative pressure drop between the cutting edges and thus maintain a constant value of hydraulic horsepower at each of the cutting edges regardless of the varying pressure losses across the power section of the PDM.

(ii) That the PDM used in the invention described in (i) above should be equipped with a bypass flow device capable of allowing the correct amount of drilling fluid required jointly at the cutting edges to pass through the PDM but restrict the amount of drilling fluid passing through the power section (stator/rotor) to equate to the desired rotational speed at the pilot drilling bit. (The rotational speed at the pilot drill bit=output speed of the PDM= rotary table speed.)

(iii) That drilling performance will be further enhanced when using the invention described in (i) above by maintaining constant cutting speed at the mean diameters of the cutting faces when drilling through the same formation at both the pilot drill bit and the hole enlarger.

(iv) That drilling performance will also be improved if when using the invention described in (i) above that the load/tooth at the pilt drill bit is equal to the load/tooth at the hole enlarger-when using a polycrystalline diamond compact bits (PDC) or similar cutter using a shearing action to cut the formation.

(v) That when drilling with the invention described in (i) the drilling fluid requirements at the cutting edges, i.e. at the pilot drill bit and the hole enlarger is calculated as a function of the cross-sectional area at the respective cutting edge and not the major diameter as is current practice.

For PDC bits and hole enlargers, it is recommended that the minimum flow requirements at the respective cutting edge is calculated according to $$Q_{MIN}=15.38A^{0.732}$$

where Q is in US gallons per minute (liters/3.785) and A is total nozzle cross sectional area at the respective cutting edge expressed in square inches (area in square cm/6.45) and the total minimum flow requirements are the summation of the minimum flow requirements at each cutting edge.

We claim:

1. A method of downhole drilling comprises mounting a downhole motor (19) within a drill pipe (13) above a hole enlarger (14) mounted at a lower end of the pipe (13) characterised by extending a transmission shaft (26) of the motor beyond the lower end of the pipe (13) to a pilot bit (28) spaced downwardly from the hole enlarger (14), whereby the hole enlarger (14) may be driven from the rotary platform of a drill rig and the pilot bit (28) by the motor transmission shaft (26), and bypassing part of the total fluid flow to the motor (19) and regulating the total fluid flow below the motor (19) between the pilot bit (28) and to the hole enlarger (14), so that the total flow of fluid is such as to permit the hydraulic requirements of the pilot bit (28) and the hole enlarger (14) to be met whilst only allowing sufficient fluid to pass through the motor stator/rotor pair (19) to give the required output speed at the pilot bit (28).

2. A downhole drill assembly comprises a drill pipe (13) having a hole enlarger (14) at a lower end, a downhole motor mounted (19) within the drill pipe (13) above the enlarger (14) characterised in that a transmission shaft (26) of the motor (19) extends beyond the enlarger (14) to a pilot bit (28) spaced below the enlarger (14), a dump valve (20) is positioned above the motor (19), a bypass split flow device (24) is positioned above the motor (19) stator/rotor pair (25) leading to a flow path bypassing the stator/rotor (25) and linking up with the rotor/stator flow path below the rotor/stator pair (25), a flow distributor is positioned below the stator/rotor and is adapted to direct the flow through a first path via jet nozzles (22) to the hole enlarger (14), a second path via jet nozzles (33) to the pilot drill bit and a third path through a bearing section (30) for an output shaft (26) of the motor (19) for the pilot bit (28).

3. An assembly as claimed in claim 2 characterised in that the hole enlarger (14) comprises a cutter (15) laterally displaced from the drilling axis and extending radially outwardly of the pilot bit (28).

4. An assembly as claimed in claim 2 characterised in that the axial spacing between the hole enlarger (14) and the drill bit (23) does not exceed 6.1 meters (20 feet).

5. An assembly as claimed in claim 2 characterised in that the power unit of the PDM, the stator/rotor section (25), is equipped with a bypass flow device (24) adapted to allow the total amount of fluid required at the pilot bit (28) and the hole enlarger (14) to pass through the PDM (19) but only have sufficient fluid pass through the stator/rotor pair (25) to give the required output speed at the pilot bit.

6. An assembly as claimed in claim 2 characterised in that the hole enlarger (14) is mounted intermediate the ends of a drill pipe (13) and comprises a rotary cutter

(15) mounted on an outwardly and upwardly inclined spindle and defining inner and outer cutting diameters.

7. An assembly as claimed in claim 6, characterised in that the pilot bit (28) has an outer diameter greater than the inner cutting diameter of the hole enlarger cutter (15).

8. An assembly as claimed in claim 6 characterised in that the hole enlarger (14) has downwardly directed flow passages (31) leading from the pipe (13) flow passage to the cutter (15) through flow restrictor jet nozzles (32), and the flow passage leads to a central flow passage of the output shaft (26) to flow restrictor or jet nozzles (33) at the pilot bit (28).

9. An assembly as claimed in claim 8, characterised in that the pipe (13) flow passage leads about the transmission output shaft (26) of the motor through bearing (30) supporting the shaft (26) and a bleed valve (34) to the lower end of the pipe (13).

10. An assembly as claimed in claim 9, characterised in that the bleed valve (34) is adapted to allow up to 5% of the drilling fluid to vent across the valve to lubricate bearings (30) supporting the output shaft (26) within the pipe (13).

* * * * *